United States Patent [19]

Vollenweider

[11] Patent Number: 4,634,024

[45] Date of Patent: Jan. 6, 1987

[54] AUTOMATIC RESIN DISPENSING APPARATUS

[75] Inventor: Edward E. Vollenweider, Pontiac, Mich.

[73] Assignee: Technical Innovations, Inc., Drayton Plains, Mich.

[21] Appl. No.: 571,341

[22] Filed: Jan. 16, 1984

[51] Int. Cl.[4] ..... B67D 5/52

[52] U.S. Cl. ..... 222/135; 222/255; 222/309; 222/334

[58] Field of Search ..... 417/62, 199 R, 426, 417/429; 222/129, 132–135, 137, 145, 255, 282, 288, 309, 333, 334, 380, 183; 169/48

[56] References Cited

U.S. PATENT DOCUMENTS

| | | | |
|---|---|---|---|
| 3,178,153 | 4/1965 | Jacomet | 169/48 |
| 3,540,626 | 11/1970 | Eberle | 222/146 |
| 3,790,030 | 2/1974 | Ives | 222/135 |
| 3,837,534 | 9/1974 | Natelson | 222/137 |
| 3,894,722 | 7/1975 | Jones | 222/135 X |
| 4,154,368 | 5/1979 | Gusmer et al. | 222/135 |
| 4,485,840 | 12/1984 | Erwin | 222/135 X |

*Primary Examiner*—F. J. Bartuska
*Assistant Examiner*—Michael S. Huppert
*Attorney, Agent, or Firm*—Harness, Dickey & Pierce

[57] ABSTRACT

An automatic resin dispensing device comprising a gear pump for pumping resin and a piston pump for pumping catalyst. Both pumps are coupled to a single air motor which drives both pumps via a dual output gear box. The piston shaft of the catalyst pump is connected to a radially located pin on a disk that is rotatably coupled to the gear reduction output of the gear box. The stroke of the piston pump, and hence the amount of catalyst relative to resin dispensed, is varied by adjusting the radial position of the connecting pin on the disk. The resin pumping system and catalyst pumping system are separated within the device to improve the safety of the device and enhance its reliability.

4 Claims, 4 Drawing Figures

AUTOMATIC RESIN DISPENSING APPARATUS

BACKGROUND AND SUMMARY OF THE INVENTION

The present invention relates to an automatic resin dispensing apparatus and in particular to an improved device for precisely metering the proper ratio of resin and catalyst selected.

For proper application of polymeric resin materials such as urethane resin or polyester resin which require the addition of a catalyst or hardener to cure the resin, it is important that the appropriate ratio of catalyst to resin be maintained. Devices for automatically metering the relative amounts of catalyst and resin to be dispensed are known in the art. However, such devices tend to be rather large, complex and expensive. In addition, these prior art devices are frequently prone to failure, tend to be difficult and expensive to service, and often constitute a fire hazard.

It is the primary object of the present invention to provide an improved automatic resin dispensing device which is highly accurate over a wide range of catalyst to resin ratios, and yet is relatively simple in construction and therefore inexpensive to manufacture.

In addition, it is an object of the present invention to provide an improved automatic resin dispensing device that significantly reduces the fire hazard associated with such polymeric materials.

Furthermore, it is an object of the present invention to provide an improved automatic resin dispensing device that is more reliable than prior art designs, requires less maintenance, and is easy to service.

In general, the automatic resin dispensing device according to the present invention comprises a gear pump for pumping resin and a piston pump for pumping catalyst. Both pumps are coupled to and driven by a single air motor which is connected to the pumps through a dual output gear box. The input shaft of the gear pump is coupled directly to one output of the gear box while the other output of the gear box is coupled to a disk having a radially located pin that is connected to the shaft of the piston pump. By altering the radial location of the pin, the stroke of the piston pump is varied and the ratio of dispensed catalyst to resin adjusted accordingly.

In addition, to enhance the safety of the device, the resin pumping system including the supply lines running to and from the resin pump are separated from the catalyst pumping system including the supply lines running to and from the catalyst pump. Thus, the accidental mixture of the polymeric components if leaks develop, which may present a fire hazard, is substantially avoided.

Additional objects and advantages of the present invention will become apparent from a reading of the following detailed description of the preferred embodiment which makes reference to the drawings in which:

DETAILED DESCRIPTION OF THE PREFERRED EMBODIMENT

Figure 1:
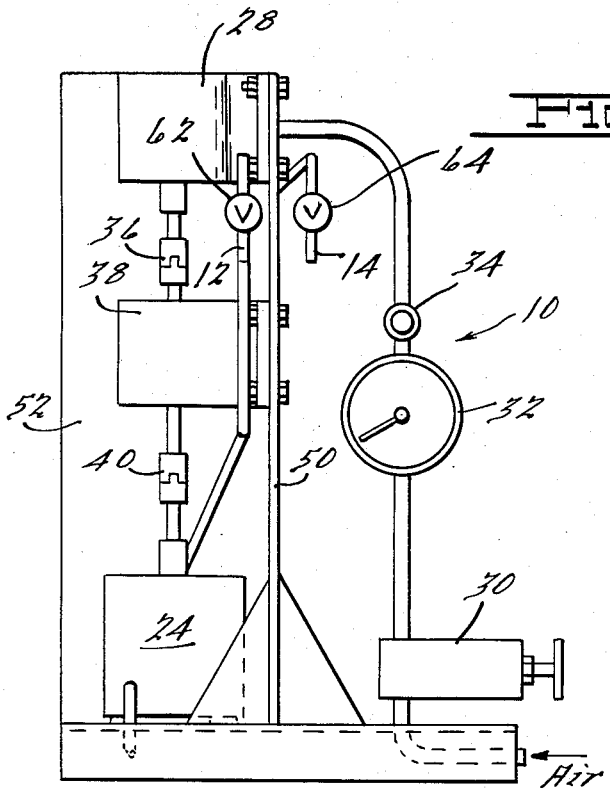
FIG. 1 is a front elevational view of an automatic resin dispensing device according to the present invention with the outer housing of the device removed for clarity.

Referring to the drawings, an automatic resin dispensing unit 10 according to the present invention is shown. The dispensing unit 10 is adapted to automatically dispense resin and catalyst from nozzles, 12 and 14 respectively, at the precise ratio selected to achieve the appropriate mixture of resin and catalyst desired for a particular application. Liquid resin is stored in a first container 16 and catalyst is stored in a second container 18. A feed line 20 connected to container 16 supplies resin from container 16 to a gear pump 24 and a second feed line 22 connected to container 18 supplies catalyst from container 18 to a piston pump 26. A positive displacement piston pump is preferably utilized for pumping the catalyst in view of the relatively small quantities of catalyst material typically required and the difficulties associated with accurately dispensing small quantities of material using small gear pumps. For example, the ratio of catalyst to resin can range as low as 0.25:100. Thus, it can be appreciated that a relatively slight variation in the amount of catalyst dispensed can produce a substantial variation in the ultimate ratio between the two ingredients.

Both gear pump 24 and piston pump 26 are driven in the preferred embodiment by a single air motor 28, although other suitable types of motors may be used. The air driven motor is preferred for this application over other types of motors, such as electric, because of the reduced possibility of generating sparks which might ignite the highly flammable catalyst and resin fumes.

Compressed air is supplied to motor 28 via an air regulator 30 which is set to a desired pressure to control the speed of the motor 28 and hence the rate at which mixture is dispensed from the unit 10. The selected air pressure is registered on a gauge 32. A start button air valve 34 is installed in the air supply line between the air gauge 32 and the motor 28 to control operation of the unit. The output shaft of the motor 28 is connected to the input 35 of a gear box 38 via a shaft coupling 36. The gear box 38 in the preferred embodiment is manufactured by Abart Gear and Machine Company and has a pair of output shafts 37 and 39. Output shaft 37 is essentially coupled directly to input shaft 35 so that output shaft 37 rotates at the speed of the output of air motor 28. Output shaft 39, on the other hand, is driven off a gear reduction mechanism internal to gear box 38 such that the rotational speed of input shaft 35 relative to output shaft 39 is 29:1.

Figure 2:
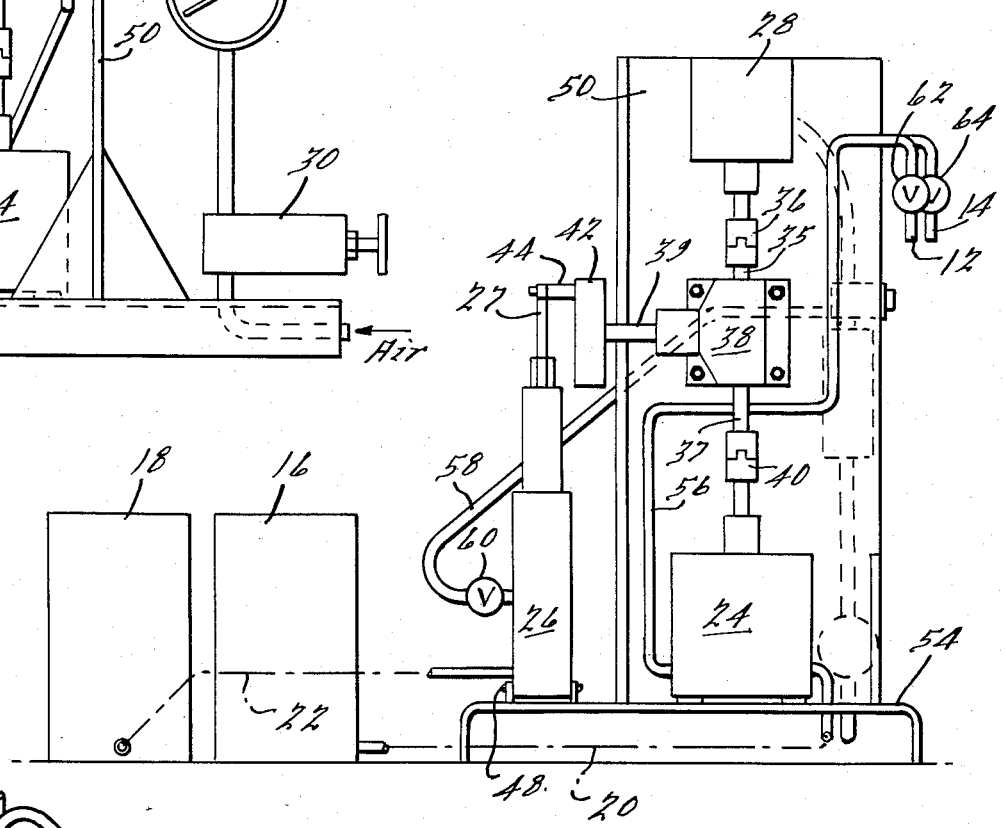
FIG. 2 is a side elevational view of the automatic resin dispensing device shown in FIG. 1.
Figure 4:
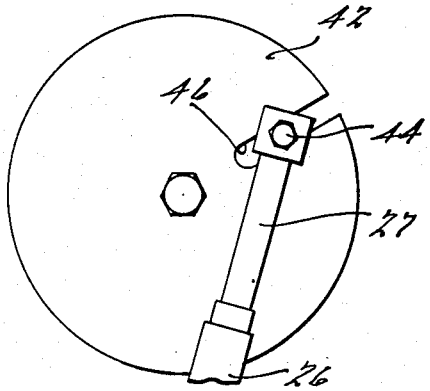
FIg. 4 is an enlarged view of the disk and radially located pin assembly connecting the piston shaft of the catalyst pump to the gear reduction output shaft of the gear box.

Output shaft 37 from gear box 38 is connected via another shaft coupling 40 to the positive displacement gear pump 24 which is adapted to pump resin from container 16 to dispensing nozzle 12. Output shaft 39 from gear box 38 in turn drives the positive displacement piston pump 26 which delivers catalyst from container 18 to dispensing nozzle 14. Output shaft 39 is connected directly to a disk 42 which has connected thereto a pin 44 that is in turn coupled to the actuating shaft 27 of piston pump 26. As best shown in FIG. 4, disk 42 has formed therein a radially extending slot 46 for receiving connecting pin 44. Connecting pin 44 is adapted to be adjustably secured to disk 42 along radial slot 46 so as to provide a means for varying the stroke of piston pump 26. By altering the stroke of piston pump 26, it will be appreciated that the volume of catalyst displaced is varied and hence the ratio of catalyst to resin dispensed by the unit is precisely controllable. In the preferred embodiment, the range of ratios of catalyst to resin can be varied between 0.25:100 and 5:100. As shown in FIG. 2, the piston pump is pivotally mounted to the base 54 of the unit at 48 to accommodate the movement of pump shaft 27 as disk 42 is rotated.

Optionally, the invention contemplates the use of a plurality of disks, each having a pin secured thereto at different radial locations on the disk such that the selective application of a particular disk corresponds to a specified catalyst to resin ratio. In this manner, the ratio of catalyst to resin can be changed simply by substituting disks.

An important safety feature of the automatic dispensing unit 10 according to the present invention is that the catalyst and resin materials are separated from each other until finally dispensed from nozzles 12 and 14. In particular, it will be noted that air motor 28, gear box 38 and gear pump 24 are located within an isolated section of the unit 10 defined by frame members 50 and 52 which form a rectangular enclosure with the outer walls of the housing of the unit 10. (Not shown in the drawings for purposes of clarity). Air motor 28 and gear box 38 are mounted to frame member 50 and gear pump 24 is mounted to the base 54 of the unit 10. In addition, the resin supply line 20 from container 16 is preferably routed below base member 54 and into the above defined enclosure through an opening in the base adjacent the inlet to gear pump 24. Similarly, the feed line 56 from the output of gear pump 24 is routed entirely within the enclosure until it connects through the outer housing wall to dispensing nozzle 12.

Figure 3:
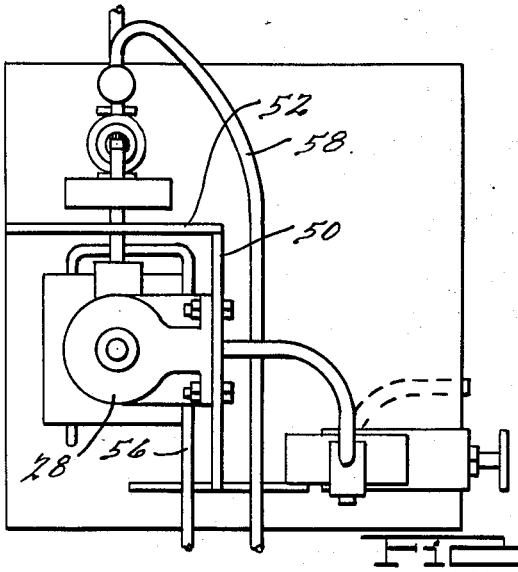
FIG. 3 is a top elevational view of the automatic resin dispensing device shown in FIG. 1.

The piston pump 26, on the other hand, is mounted to the base 54 on the opposite side of frame member 52. In addition, the catalyst supply line 22 from container 18 is connected to the inlet of the piston pump 26 through the rear wall of the outer housing, and the feed line 58 from the output of the piston pump 26 is routed outside the aforementioned enclosure to dispensing nozzle 14 as shown in FIG. 3. Thus, it will be appreciated that frame members 50 and 52 which isolate the resin pumping system from the catalyst pumping system within the unit 10, are penetrated only by the air supply line to the air motor 28 and the gear reduction output shaft 39 connecting the gear box 38 to the disk 42. The purpose of separating the catalyst and resin pumping systems is to minimize the possibility of an accidental mixture of the polymeric ingredients in the event leaks develop, which is a frequent cause of accidental fires in prior art dispensing units.

To further enhance the accuracy of the present dispensing unit 10, particularly upon initial activation of the unit after a previous shutdown, the dispensing unit preferably includes a pair of check valves 62 and 64 located at the two dispensing nozzles 12 and 14. Check valves 62 and 64 prevent the dispensing nozzles 12 and 14 from dripping after shutdown and thus eliminate the necessity of having to dispose of the initial mixture dispensed by the unit 10 upon start-up until the entire system has been "flushed" and proper proportioning is assured. Additionally, a further check valve 60 is disposed in the feed line 58 at the output of piston pump 26 to prevent catalyst from draining back into the pump after shutdown. A similar check valve is incorporated into the piston pump 26 at the inlet to the pump to prevent catalyst from draining from the pump.

While the above description constitutes the preferred embodiment of the present invention, it will be appreciated that the invention is susceptible to modification, variation and change without departing from the proper scope or fair meaning of the accompanying claims.

I claim:

1. A device for automatically dispensing catalyst and resin material at a preselected quantity ratio, comprising:

a positive displacement gear pump for dispensing resin from a first remote container, a positive displacement piston pump for dispensing catalyst from a second remote container, motive means for driving said gear pump and said piston pump comprising a motor and reduction means coupled to the output of said motor, said reduction means having first and second outputs thereof with the motive drive at said second output being substantially reduced relative to the motive drive at said first output, first coupling means for connecting said gear pump to said first output of said reduction means, and second coupling means for connecting said piston pump to said second output of said reduction means and including control means for controlling the volumetric displacement of said piston pump relative to said gear pump so as to achieve said preselected ratio of catalyst to resin material dispensed.

2. The automatic dispensing device of claim 1 wherein said control means comprises a disk rotatably driven by said motive means and having connected thereto a pin for connection to the actuator shaft of said piston pump such that the radial position of said pin on said disk determines the length of the stroke of said piston pump.

3. The automatic dispensing unit of claim 2 wherein said motive means comprises a single air motor for driving both said gear pump and said piston pump.

4. The automatic dispensing unit of claim 3 further including check valves located at the dispensing output of the device to prevent discharge of material after said air motor is deactivated.

* * * * *